US011408422B2

(12) United States Patent
Murakami et al.

(10) Patent No.: US 11,408,422 B2
(45) Date of Patent: Aug. 9, 2022

(54) SCROLL COMPRESSOR HAVING AN ARCUATE PORTION SIDE SURFACE CLEARANCE LARGER THAN A SPIRAL PORTION SIDE SURFACE CLEARANCE

(71) Applicant: Daikin Industries, LTD., Osaka (JP)

(72) Inventors: Yasuhiro Murakami, Osaka (JP); Yasuo Mizushima, Osaka (JP); Ryouta Nakai, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 61 days.

(21) Appl. No.: 16/606,262

(22) PCT Filed: May 25, 2018

(86) PCT No.: PCT/JP2018/020180
§ 371 (c)(1),
(2) Date: Oct. 18, 2019

(87) PCT Pub. No.: WO2018/221416
PCT Pub. Date: Dec. 6, 2018

(65) Prior Publication Data

US 2021/0108637 A1 Apr. 15, 2021

(30) Foreign Application Priority Data

Jun. 1, 2017 (JP) ..... JP2017-109093

(51) Int. Cl.
*F04C 18/02* (2006.01)

(52) U.S. Cl.
CPC ..... *F04C 18/0215* (2013.01); *F04C 18/0269* (2013.01); *F04C 2210/26* (2013.01);
(Continued)

(58) Field of Classification Search
CPC ..... F04C 18/0215; F04C 18/0223; F04C 18/0246; F04C 18/0269; F04C 2/025;
(Continued)

(56) References Cited

U.S. PATENT DOCUMENTS 6,345,967 B1 2/2002 Mukai et al.
10,920,775 B2 * 2/2021 Nakai ..... F04C 18/0269
2016/0348677 A1 * 12/2016 Nakano ..... F04C 23/008

FOREIGN PATENT DOCUMENTS

EP 2 527 655 A1 11/2012
JP H06101665 A 4/1994
(Continued)

OTHER PUBLICATIONS

European Search Report of corresponding EP Application No. 18 80 8746.4 dated Nov. 9, 2020.
(Continued)

*Primary Examiner* — Laert Dounis
(74) *Attorney, Agent, or Firm* — Global IP Counselors, LLP

(57) ABSTRACT

A fixed scroll wrap (52) includes a fixed spiral portion (57) having a spiral shape and a fixed arcuate portion (58) having an arcuate shape. A movable scroll wrap (62) includes a movable spiral portion (67) having a spiral shape and a movable arcuate portion (68) having an arcuate shape. An arcuate portion side surface clearance (GA) is defined by the fixed arcuate portion (58) and one of the movable spiral portion (67) and the movable arcuate portion (68), or is defined by the movable arcuate portion (68) and one of the fixed spiral portion (57) and the fixed arcuate portion (58). A spiral portion side surface clearance (GI) is defined by the fixed spiral portion (57) and the movable spiral portion (67). The arcuate portion side surface clearance (GA) is larger than the spiral portion side surface clearance (GI).

6 Claims, 7 Drawing Sheets

(52) U.S. Cl.
CPC .... *F04C 2210/268* (2013.01); *F04C 2240/20* (2013.01); *F04C 2240/30* (2013.01); *F04C 2270/17* (2013.01)

(58) Field of Classification Search
CPC ..... F04C 2210/268; F04C 2270/17; F01C 1/0215; F01C 1/0223; F01C 1/0246; F01C 1/0269
See application file for complete search history.

(56) References Cited

FOREIGN PATENT DOCUMENTS

| | | | |
|---|---|---|---|
| JP | H11159481 | A | 6/1999 |
| JP | 2003-343456 | A | 12/2003 |
| JP | 2010-19176 | A | 1/2010 |
| JP | 2015-71947 | A | 4/2015 |

OTHER PUBLICATIONS

International Search Report of the International Searching Authority for PCT/JP2018/020180 dated Aug. 21, 2018.
Translation of the International Search Report of the International Searching Authority for PCT/JP2018/020180 dated Aug. 21, 2018.
International Preliminary Report of corresponding PCT Application No. PCT/JP2018/020180 dated Dec. 12, 2019.

* cited by examiner

SCROLL COMPRESSOR HAVING AN ARCUATE PORTION SIDE SURFACE CLEARANCE LARGER THAN A SPIRAL PORTION SIDE SURFACE CLEARANCE

TECHNICAL FIELD

The present invention relates to a scroll compressor.

BACKGROUND ART

In a scroll compressor, compression chambers are defined in such a manner that a movable scroll including a spiral scroll wrap comes into contact with a fixed scroll including a spiral scroll wrap, at a plurality of seal points. The scrolls are in contact at their respective portions with fluid at different pressures and, accordingly, become deformed in some instances owing to the pressure difference. In order to prevent occurrence of abnormal events of operation due to such deformation, in a scroll compressor disclosed in Patent Literature 1 (JP 2015-071947 A), the dimensions of a clearance between a side surface of a movable scroll wrap and a side surface of a fixed scroll wrap are adjusted so that the clearance between the side surfaces could accommodate a deformation.

SUMMARY OF THE INVENTION

Technical Problem

Some scroll wraps are formed to have an arcuate central portion rather than a spiral central portion, in order to improve a compression ratio. However, such an arcuate portion thermally expands to cause positional deviation of a seal point, which exerts an influence upon an entire scroll wrap including a spiral portion. This influence causes positional deviation of a plurality of seal points. This positional deviation causes occurrence of a refrigerant leak, which may reduce compression performance. Use of a refrigerant whose temperature may be high accelerates the thermal expansion of the arcuate portion, which may further reduce the compression performance.

It is an object of the present invention to provide a scroll compressor that reduces degradation in compression performance even when thermal expansion occurs at an arcuate portion.

Solutions to Problem

According to a first aspect of the present invention, a scroll compressor includes a fixed scroll including a fixed scroll wrap, and a movable scroll including a movable scroll wrap. The fixed scroll wrap includes a fixed spiral portion having a spiral shape and a fixed arcuate portion having an arcuate shape, the fixed arcuate portion being smaller in radius of curvature than the fixed spiral portion. The movable scroll wrap includes a movable spiral portion having a spiral shape and a movable arcuate portion having an arcuate shape, the movable arcuate portion being smaller in radius of curvature than the movable spiral portion. An arcuate portion side surface clearance is defined by the fixed arcuate portion and one of the movable spiral portion and the movable arcuate portion, or is defined by the movable arcuate portion and one of the fixed spiral portion and the fixed arcuate portion. A spiral portion side surface clearance is defined by the fixed spiral portion and the movable spiral portion. The arcuate portion side surface clearance is larger than the spiral portion side surface clearance.

According to this configuration, the arcuate portion side surface clearance is larger than the spiral portion side surface clearance. Accordingly, the arcuate portion side surface clearance accommodates a deformation of an arcuate portion that may exert an influence on the entire corresponding scroll. This configuration therefore suppresses positional deviation of a scroll wrap and, in turn, reduces degradation in compression performance.

According to a second aspect of the present invention, in the scroll compressor according to the first aspect, a ratio of the arcuate portion side surface clearance to the spiral portion side surface clearance is equal to or more than 1.2.

According to this configuration, the arcuate portion side surface clearance is at least 1.2 times as large as the spiral portion side surface clearance. Accordingly, the arcuate portion side surface clearance accommodates a greater deformation of an arcuate portion by a difference of 20%. This configuration therefore suppresses positional deviation of a scroll wrap more reliably.

According to a third aspect of the present invention, in the scroll compressor according to the first or second aspect, at least one of a ratio of a thickness of the fixed arcuate portion to a thickness of the fixed spiral portion and a ratio of a thickness of the movable arcuate portion to a thickness of the movable spiral portion is equal to or more than 1.2.

According to this configuration, the thickness of the arcuate portion is at least 1.2 times as large as the thickness of the spiral portion. The thick arcuate portion is larger in increase in thickness due to thermal expansion than the spiral portion. Accordingly, the large arcuate portion side surface clearance accommodates the increase in thickness. This configuration therefore suppresses positional deviation of a scroll wrap more reliably.

According to a fourth aspect of the present invention, in the scroll compressor according to any one of the first to third aspects, the spiral portion side surface clearance is a larger one of an A chamber side surface clearance and a B chamber side surface clearance. The A chamber side surface clearance is defined by an inner line of the fixed scroll wrap and an outer line of the movable scroll wrap. The B chamber side surface clearance is defined by an outer line of the fixed scroll wrap and an inner line of the movable scroll wrap.

According to this configuration, the spiral portion side surface clearance has dimensions set based on a larger one of the A chamber side surface clearance and the B chamber side surface clearance. In a case where the A chamber-side side surface clearance is different in dimensions from the B chamber-side side surface clearance, therefore, this configuration enables a determination as to which portion of scroll wraps is used for setting the dimensions of the spiral portion side surface clearance.

According to a fifth aspect of the present invention, in the scroll compressor according to any one of the first to fourth aspects, the fixed scroll further includes a fixed loose portion on its end opposite to the fixed arcuate portion, the fixed loose portion being adjacent to the fixed spiral portion, or the movable scroll further includes a movable loose portion on its end opposite to the movable arcuate portion, the movable loose portion being adjacent to the movable spiral portion. A loose portion side surface clearance is defined by the fixed loose portion and one of the movable spiral portion and the movable loose portion, or is defined by the movable loose portion and one of the fixed spiral portion and the fixed loose portion. The loose portion side surface clearance is larger than the spiral portion side surface clearance.

According to this configuration, the loose portion side surface clearance GL is larger than the spiral portion side surface clearance GI. Accordingly, a pressing force between the scroll wraps is reduced at the fixed loose portion or the movable loose portion. This configuration therefore enables improvement in strength of each scroll wrap.

According to a sixth aspect of the present invention, the scroll compressor according to any one of the first to fifth aspects is configured to compress a refrigerant higher in discharge temperature than an R410A refrigerant.

According to this configuration, the scroll compressor employs a high-temperature refrigerant. The high-temperature refrigerant causes greater thermal expansion of an arcuate portion. The large arcuate portion side surface clearance accommodates the increase in thickness due to the thermal expansion. This configuration therefore suppresses positional deviation of a scroll more reliably.

Advantageous Effects of the Invention

A scroll compressor according to the present invention suppresses positional deviation of scroll wraps and, in turn, reduces degradation in compression performance.

DESCRIPTION OF EMBODIMENTS

First Embodiment (1) General Configuration

Figure 1:
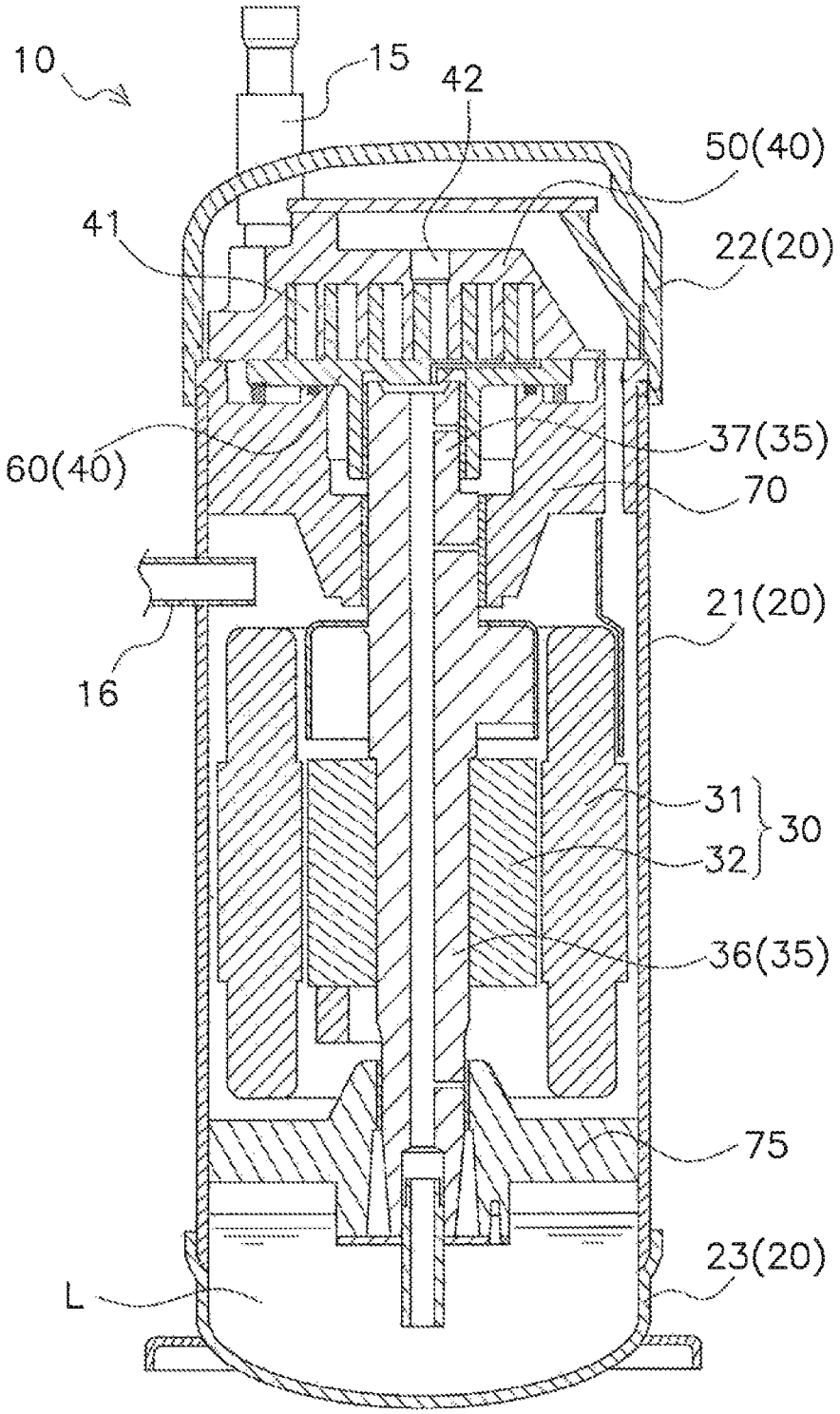
FIG. 1 is a sectional view of a scroll compressor 10 according to a first embodiment of the present invention.

FIG. 1 illustrates a scroll compressor 10 according to a first embodiment of the present invention. The scroll compressor 10 is installed in, for example, an air conditioning apparatus in order to compress a refrigerant that is a fluid. The scroll compressor 10 includes a casing 20, a motor 30, a crank shaft 35, a compression mechanism 40, and frame members 70 and 75.

A refrigerant to be compressed by the scroll compressor 10 is apt to bring, for example, peripheries of a fixed scroll 50 and movable scroll 60 of the compression mechanism 40 into relatively high temperature and pressure. In other words, a refrigerant to be compressed by the scroll compressor 10 is relatively high in condensation pressure. Specific examples of the refrigerant to be compressed by the scroll compressor 10 may include: R32 (R32 alone); a refrigerant mixture containing at least 50% of R32 (e.g., R410A, R452B, R454B); and a refrigerant mixture of R1123 and R32. The refrigerant to be compressed by the scroll compressor 10 is higher in condensation pressure than R410A, and examples thereof may particularly include R32 and a refrigerant mixture of R1123 and R32. However, the refrigerant to be compressed by the scroll compressor 10 is not limited to those described above.

For example, the scroll compressor 10 is configured to compress a refrigerant higher in discharge temperature than an R410A refrigerant.

(2) Specific Configuration (2-1) Casing 20

The casing 20 houses therein the refrigerant and the various constituent elements of the scroll compressor 10. The casing 20 is resistant to high pressure of the refrigerant. The casing 20 includes a main body portion 21, an upper portion 22, and a lower portion 23 that are joined together. The upper portion 22 has a suction pipe 15 mounted thereto for sucking the low-pressure gas refrigerant. The main body portion 21 has a discharge pipe 16 mounted thereto for discharging the high-pressure gas refrigerant. In the lower portion 23 of the casing 20, a lubricating oil L is sealed for lubricating sliding portions of the respective constituent elements.

(2-2) Motor 30

The motor 30 is configured to receive electric power to generate power for compressing the refrigerant. The motor 30 includes a stator 31 and a rotor 32. The stator 31 is fixed to the main body portion 21 of the casing 20. The stator 31 includes windings (not illustrated). The windings receive electric power to generate an alternating-current magnetic field. The rotor 32 is rotatably disposed inside a central cavity of the stator 31. The rotor 32 has permanent magnets (not illustrated) embedded therein. When the permanent magnets receive force from the alternating-current magnetic field, the rotor 32 rotates to generate power.

(2-3) Crank Shaft 35

The crank shaft 35 is configured to transmit to the compression mechanism 40 power generated by the motor 30. The crank shaft 35 includes a main shaft portion 36 and an eccentric portion 37. The main shaft portion 36 is fixed to penetrate through the rotor 32, and is disposed concentrically with the rotor 32. The eccentric portion 37 is disposed eccentrically to the rotor 32, and is connected to the compression mechanism 40.

(2-4) Compression Mechanism 40

The compression mechanism 40 is configured to compress the low-pressure gas refrigerant to generate the high-pressure gas refrigerant. The compression mechanism 40 includes the fixed scroll 50 and the movable scroll 60. The fixed scroll 50 is directly or indirectly fixed to the casing 20. The movable scroll 60 is connected to the eccentric portion 37 of the crank shaft 35, and is revolvable with respect to the fixed scroll 50. The fixed scroll 50 and the movable scroll 60 define a compression chamber 41. The revolution of the movable scroll 60 causes a change in volumetric capacity of the compression chamber 41. The compression mechanism 40 thus compresses the low-pressure gas refrigerant to generate the high-pressure gas refrigerant. The high-pressure gas refrigerant is discharged from the compression mechanism 40 through a discharge port 42.

(2-5) Frame Members 70, 75

The frame members 70 and 75 support the crank shaft 35 in a rotatable manner. The frame member 70 supports an upper side of the main shaft portion 36. The frame member 75 supports a lower side of the main shaft portion 36. The frame members 70 and 75 are directly or indirectly fixed to the casing 20.

(3) Operation of Scroll Compressor 10

Externally supplied electric power causes rotation of the rotor 32 of the motor 30 illustrated in FIG. 1. The rotation of the rotor 32 is transmitted to the main shaft portion 36 of the crank shaft 35. The power from the eccentric portion 37 of the crank shaft 35 causes the revolution of the movable scroll 60 relative to the fixed scroll 50. The low-pressure gas refrigerant flows through the suction pipe 15, and then flows into a compression chamber 41 on the outer periphery of the compression mechanism 40. When the movable scroll 60 revolves, the compression chamber 41 moves toward the center of the compression mechanism 40 with the volumetric capacity thereof gradually reduced. In this process, the compression mechanism 40 compresses the low-pressure gas refrigerant to generate the high-pressure gas refrigerant. The high-pressure gas refrigerant is discharged from the compression mechanism 40 through the discharge port 42. The high-pressure gas refrigerant then flows into a space inside the casing 20. The high-pressure gas refrigerant is then discharged from the casing 20 through the discharge pipe 16.

(4) Specific Configuration of Compression Mechanism 40

Figure 2:
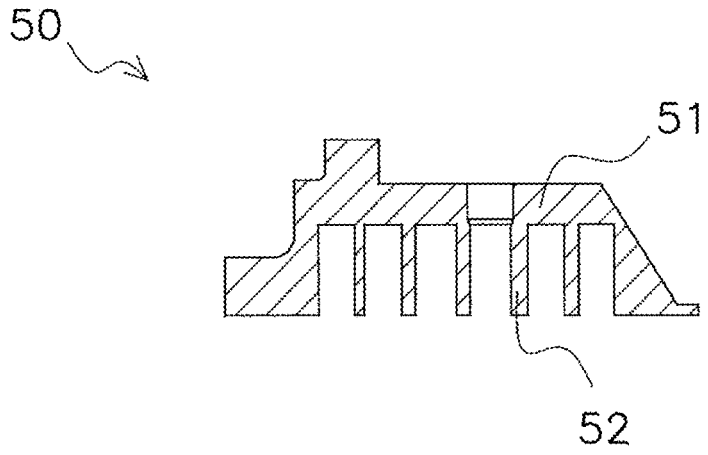
FIG. 2 is a sectional view of a fixed scroll 50 of a compression mechanism 40.

FIG. 2 illustrates the fixed scroll 50. The fixed scroll 50 includes a fixed scroll end plate 51 and a fixed scroll wrap 52 disposed upright on the fixed scroll end plate 51.

Figure 3:
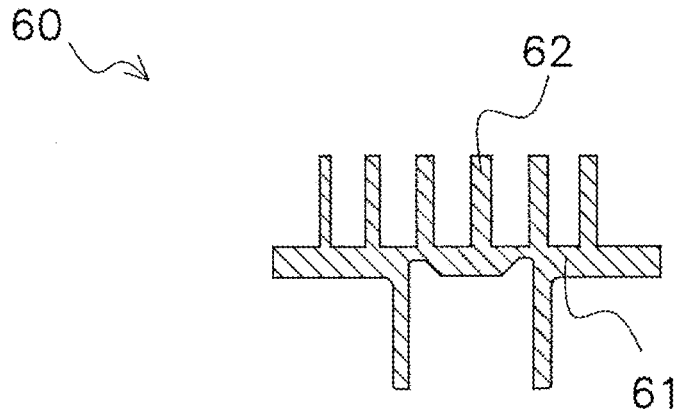
FIG. 3 is a sectional view of a movable scroll 60 of the compression mechanism 40.

FIG. 3 illustrates the movable scroll 60. The movable scroll 60 includes a movable scroll end plate 61 and a movable scroll wrap 62 disposed upright on the movable scroll end plate 61.

Figure 4:
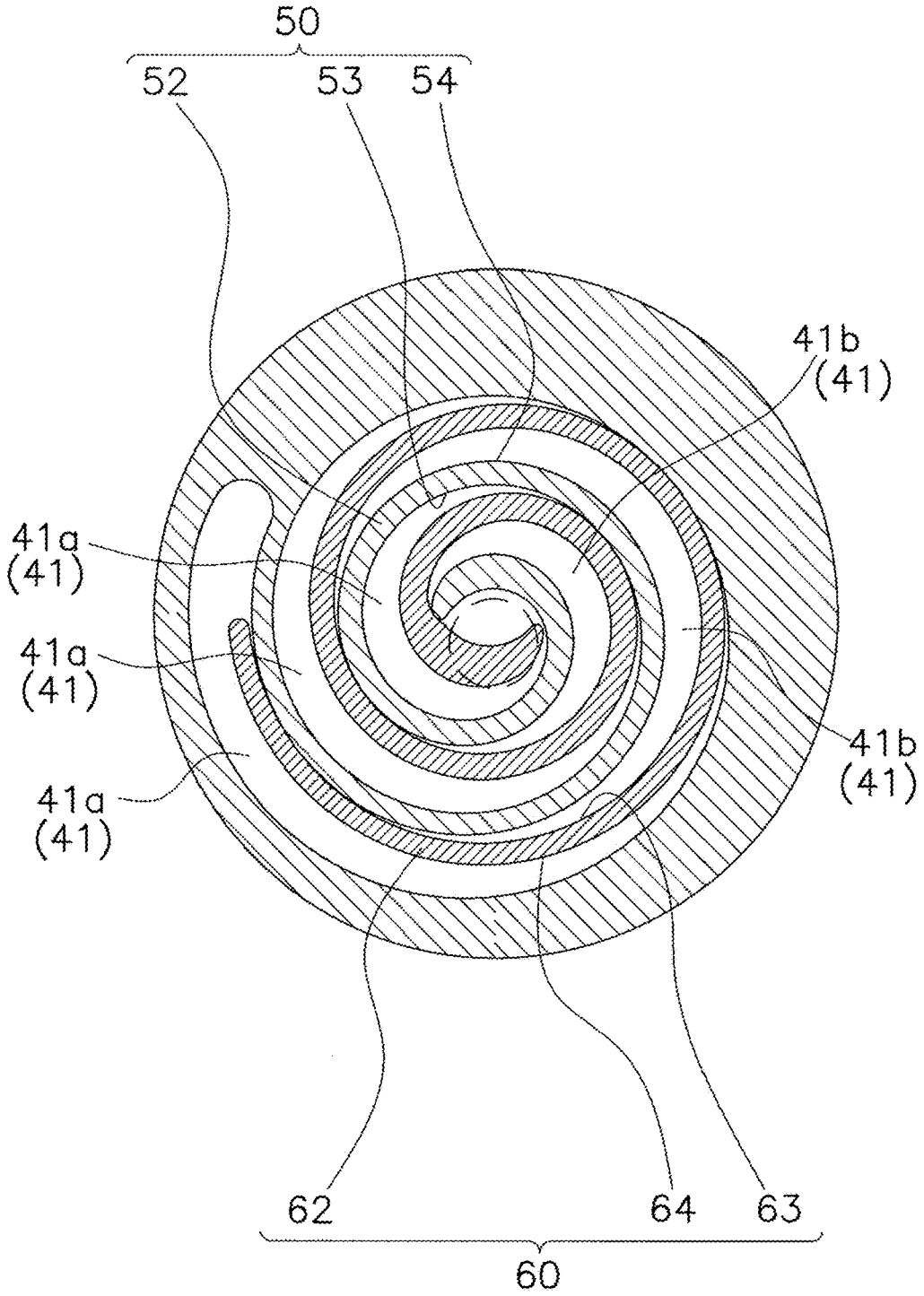
FIG. 4 is a sectional view taken along a horizontal plane of the compression mechanism 40.

FIG. 4 is a sectional view taken along a horizontal plane of the compression mechanism 40. The fixed scroll wrap 52 and the movable scroll wrap 62 are disposed in proximity to each other at a plurality of positions. These positions are closed with the lubricating oil L to form seal points SP illustrated in FIG. 5. As illustrated in FIG. 4, the seal points SP define a plurality of compression chambers 41 that are separated from one another. The fixed scroll wrap 52 has a fixed scroll wrap inner line 53 as its central-side edge, and a fixed scroll wrap outer line 54 as its outer peripheral-side edge. The movable scroll wrap 62 has a movable scroll wrap inner line 63 as its central-side edge, and a movable scroll wrap outer line 64 as its outer peripheral-side edge. Of the plurality of compression chambers 41 illustrated in FIG. 4, a compression chamber 41 defined by the fixed scroll wrap inner line 53 and the movable scroll wrap outer line 64 is referred to as an A chamber 41*a*. In addition, a compression chamber 41 defined by the fixed scroll wrap outer line 54 and the movable scroll wrap inner line 63 is referred to as a B chamber 41*b*.

Figure 5:
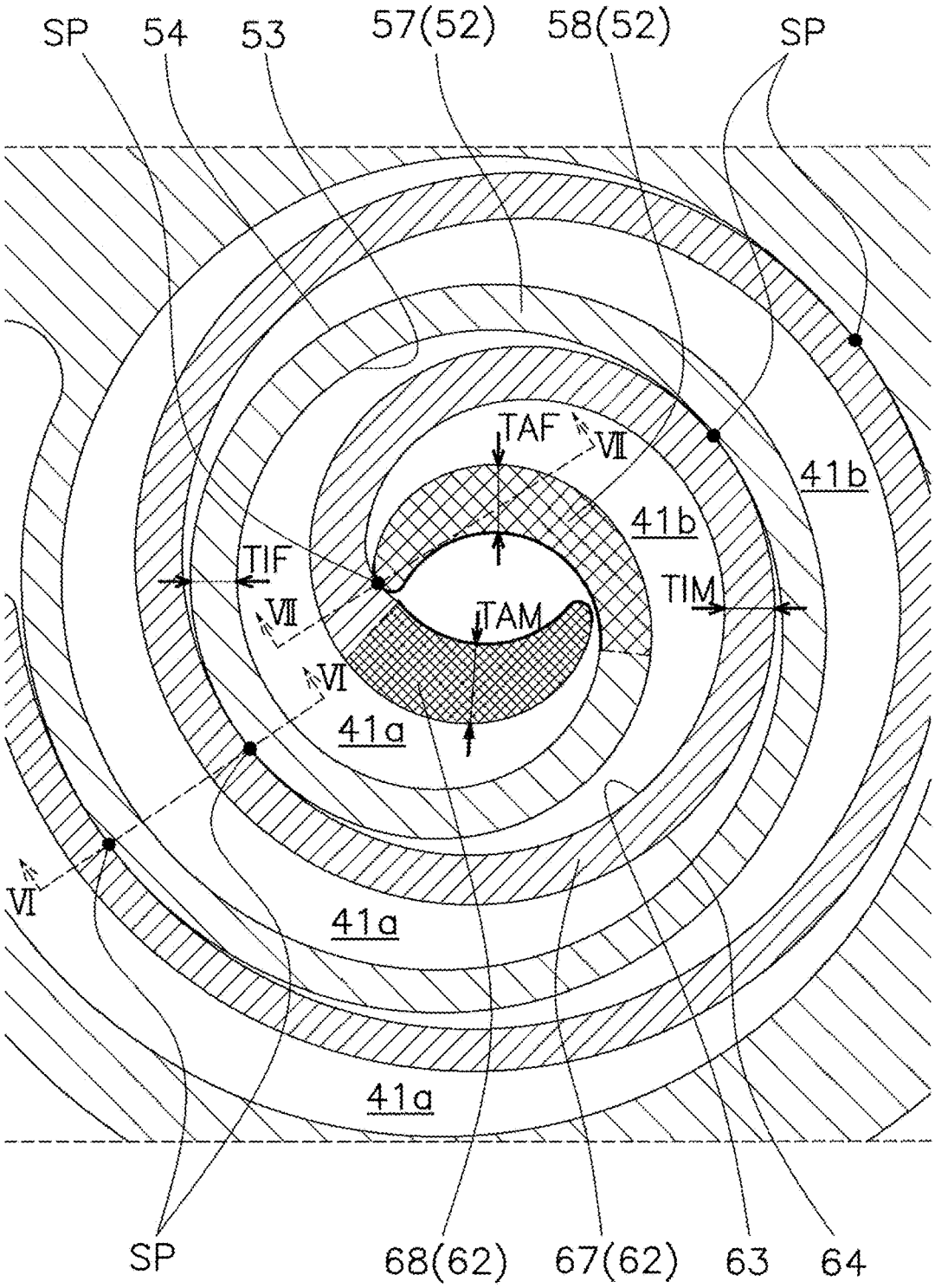
FIG. 5 is a sectional view taken along the horizontal plane of the compression mechanism 40.

FIG. 5 illustrates an enlarged central portion of FIG. 4. The fixed scroll wrap 52 includes a fixed spiral portion 57 that occupies most of the fixed scroll wrap 52 along the length, and a fixed arcuate portion 58 that constitutes one end at the center of the compression mechanism 40. The fixed spiral portion 57 has a spiral shape such as an involute curve shape. Alternatively, the fixed spiral portion 57 may have an algebraic spiral shape. The fixed arcuate portion 58 has an arcuate shape. The fixed arcuate portion 58 is smaller in radius of curvature than the fixed spiral portion 57. The fixed spiral portion 57 has a thickness TIF. The fixed arcuate portion 58 has a thickness TAF.

Likewise, the movable scroll wrap 62 includes a movable spiral portion 67 that occupies most of the movable scroll wrap 62 along the length, and a movable arcuate portion 68 that constitutes one end at the center of the compression mechanism 40. The movable spiral portion 67 has a spiral shape such as an involute curve shape. Alternatively, the movable spiral portion 67 may have an algebraic spiral shape. The movable arcuate portion 68 has an arcuate shape. The movable arcuate portion 68 is smaller in radius of curvature than the movable spiral portion 67. The movable spiral portion 67 has a thickness TIM. The movable arcuate portion 68 has a thickness TAM.

The fixed arcuate portion 58 and the movable arcuate portion 68 are respectively smaller in radius of curvature than the fixed spiral portion 57 and the movable spiral portion 67, which contributes to improvement in compression ratio.

Figure 6:
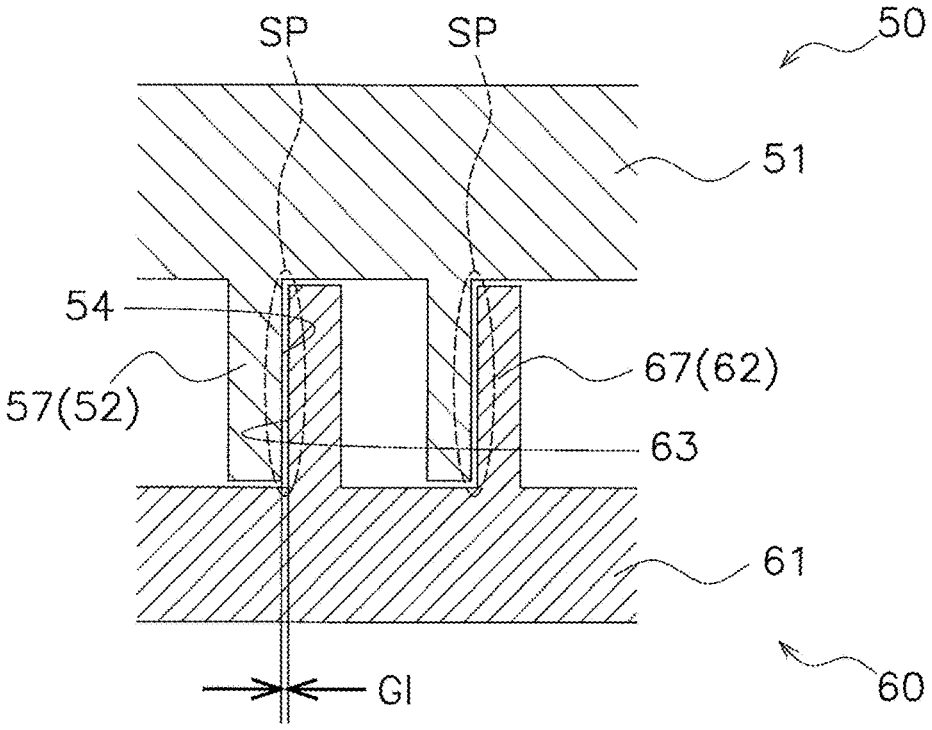
FIG. 6 is a schematic sectional view taken along line VI-VI in FIG. 5.

FIG. 6 illustrates a cross-section of the compression mechanism 40. As to the fixed scroll wrap 52, FIG. 6 illustrates only the fixed spiral portion 57. As to the movable scroll wrap 62, FIG. 6 illustrates only the movable spiral portion 67. FIG. 6 illustrates the case in which the movable scroll wrap inner line 63 is the closest to the fixed scroll wrap outer line 54. A seal point SP is formed at a position between the movable scroll wrap inner line 63 and the fixed scroll wrap outer line 54 that are in proximity to each other. An interstice between the fixed spiral portion 57 and the movable spiral portion 67 that are in the closest proximity to each other is referred to as a spiral portion side surface clearance GI. Here, an interstice between the fixed scroll wrap inner line 53 and the movable scroll wrap outer line 64 is referred to as an A chamber side surface clearance, whereas an interstice between the fixed scroll wrap outer line 54 and the movable scroll wrap inner line 63 is referred to as a B chamber side surface clearance. A larger one of the A chamber side surface clearance and the B chamber side surface clearance is defined as the spiral portion side surface clearance GI. The spiral portion side surface clearance GI illustrated in FIG. 6 is the B chamber side surface clearance.

Figure 7:
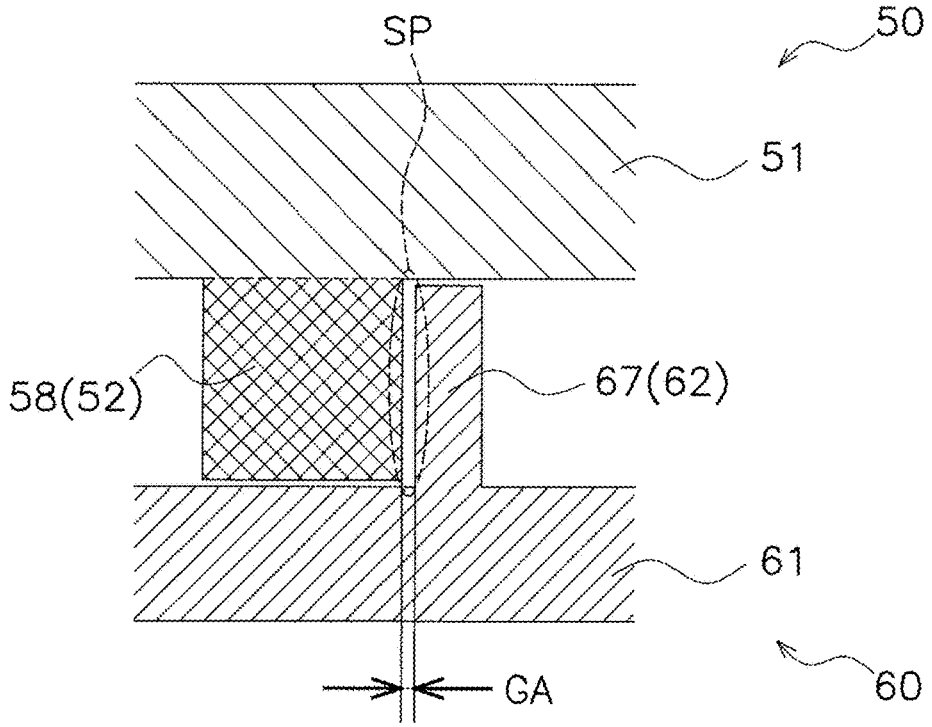
FIG. 7 is a schematic sectional view taken along line VII-VII in FIG. 5.

FIG. 7 illustrates a cross-section of the central portion of the compression mechanism 40. As to the fixed scroll wrap 52, FIG. 7 illustrates the fixed arcuate portion 58. As to the movable scroll wrap 62, FIG. 7 illustrates the movable spiral portion 67. FIG. 7 illustrates the case in which the movable spiral portion 67 is the closest to the fixed arcuate portion 58. An interstice at a position between the movable spiral portion 67 and the fixed arcuate portion 58 that are proximity to each other is filled with the lubricating oil L to form a seal point SP. A smallest one of an interstice between the movable spiral portion 67 and the fixed arcuate portion 58, an interstice between the fixed spiral portion 57 and the movable arcuate portion 68, and an interstice between the fixed arcuate portion 58 and the movable arcuate portion 68 is defined as an arcuate portion side surface clearance GA.

In the scroll compressor 10 according to the present embodiment, the compression mechanism 40 has dimensions set as follows.

The arcuate portion side surface clearance GA is set to be larger than the spiral portion side surface clearance GI. Specifically, a ratio (GA/GI) of the arcuate portion side surface clearance GA to the spiral portion side surface clearance GI is equal to or more than 1.2. Furthermore, the ratio (GA/GI) of the arcuate portion side surface clearance GA to the spiral portion side surface clearance GI may be equal to or less than 10. Preferably, the ratio (GA/GI) is equal to or less than 5.

A ratio (TAF/TIF) of the thickness TAF of the fixed arcuate portion 58 to the thickness TIF of the fixed spiral portion 57 is equal to or more than 1.2. Alternatively, a ratio (TAM/TIM) of the thickness TAM of the movable arcuate portion 68 to the thickness TIM of the movable spiral portion 67 may be equal to or more than 1.2. Still alternatively, each of the ratios may be equal to or more than 1.2.

(5) Features (5-1)

The arcuate portion side surface clearance GA is larger than the spiral portion side surface clearance GI. Accordingly, the arcuate portion side surface clearance GA accommodates a deformation of the fixed arcuate portion 58 or movable arcuate portion 68 that may exert an influence on the entire fixed scroll 50 and movable scroll 60. This configuration therefore suppresses positional deviation of the fixed scroll wrap 52 and movable scroll wrap 62 and, in turn, reduces degradation in compression performance.

(5-2)

The arcuate portion side surface clearance GA is at least 1.2 times as large as the spiral portion side surface clearance GI. Accordingly, the arcuate portion side surface clearance GA accommodates a greater deformation of the fixed arcuate portion 58 or movable arcuate portion 68 by a difference of 20%. This configuration therefore suppresses positional deviation of the fixed scroll wrap 52 and movable scroll wrap 62 more reliably.

(5-3)

The ratio (TAF/TIF) of the thickness TAF of the fixed arcuate portion 58 to the thickness TIF of the fixed spiral portion 57 or the ratio (TAM/TIM) of the thickness TAM of the movable arcuate portion 68 to the thickness TIM of the movable spiral portion 67 is equal to or more than 1.2. The fixed arcuate portion 58 or movable arcuate portion 68 is large in thickness, and is therefore larger in increase in thickness due to thermal expansion than the fixed spiral portion 57 or movable spiral portion 67. Accordingly, the large arcuate portion side surface clearance GA accommodates the increase in thickness. This configuration therefore suppresses positional deviation of the fixed scroll wrap 52 and the movable scroll wrap 62 more reliably.

(5-4)

The spiral portion side surface clearance GI has the dimensions set based on a larger one of the A chamber side surface clearance and the B chamber side surface clearance. In a case where the A chamber-side side surface clearance is different in dimensions from the B chamber-side side surface clearance, therefore, this configuration enables a determination as to which portion of the scroll wraps is used for setting the dimensions of the spiral portion side surface clearance GI.

(5-5)

The scroll compressor 10 employs a refrigerant whose discharge temperature may be high, such as an R32 refrigerant. The high-temperature refrigerant causes greater thermal expansion of the fixed arcuate portion 58 or movable arcuate portion 68. The large arcuate portion side surface clearance GA accommodates the increase in thickness due to the thermal expansion. This configuration therefore suppresses positional deviation of the fixed scroll wrap 52 and movable scroll wrap 62 more reliably.

(6) Modifications

The following description concerns modifications of the present embodiment. The following modifications may be combined with one another as appropriate.

(6-1) Modification 1A

In the above-described embodiment, the spiral portion side surface clearance GI is defined by a larger one of the A chamber side surface clearance and the B chamber side surface clearance. Alternatively, the spiral portion side surface clearance GI may be defined by a smaller one of the A chamber side surface clearance and the B chamber side surface clearance. Still alternatively, the spiral portion side surface clearance GI may be defined by the A chamber side surface clearance. Yet alternatively, the spiral portion side surface clearance GI may be defined by the B chamber side surface clearance.

This configuration produces an effect of reducing degradation in compression performance even when thermal expansion occurs at an arcuate portion, and enables a change of limiting conditions concerning design.

(6-2) Modification 1B

In the above-described embodiment, the arcuate portion side surface clearance GA is defined by the smallest one of the interstice between the movable spiral portion 67 and the fixed arcuate portion 58, the interstice between the fixed spiral portion 57 and the movable arcuate portion 68, and the interstice between the fixed arcuate portion 58 and the movable arcuate portion 68. Alternatively, the arcuate portion side surface clearance GA may be defined by the largest one of the three interstices. Still alternatively, the arcuate portion side surface clearance GA may always be defined by selected one of the three interstices.

This configuration produces an effect of reducing degradation in compression performance even when thermal expansion occurs at an arcuate portion, and enables a change of limiting conditions concerning design.

Second Embodiment (1) General Configuration

Figure 8:
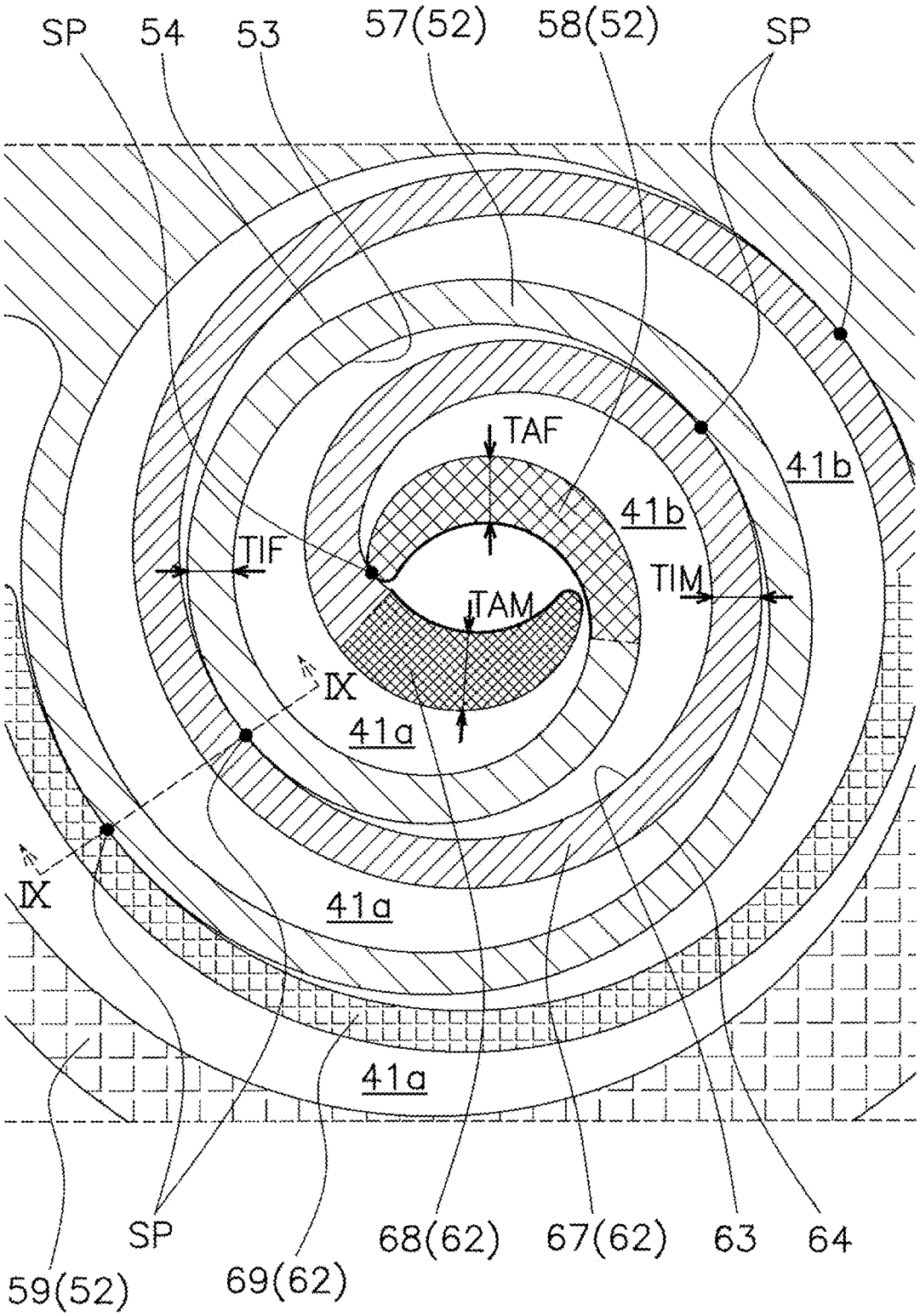
FIG. 8 is a sectional view taken along a horizontal plane of a compression mechanism 40A of a scroll compressor 10 according to a second embodiment of the present invention.

FIG. 8 is a sectional view taken along a horizontal plane of a compression mechanism 40A of a scroll compressor 10 according to a second embodiment of the present invention. The compression mechanism 40A is different from the compression mechanism 40 according to the first embodiment in that a fixed scroll wrap 52 includes a fixed loose portion 59, and a movable scroll wrap 62 includes a movable loose portion 69. The fixed loose portion 59 and the movable loose portion 69 each have a spiral shape as in the fixed arcuate portion 58 and the movable arcuate portion 68. As will be described later, the fixed loose portion 59 and the movable loose portion 69 each have dimensions designed to define a large side surface clearance.

The fixed scroll wrap 52 includes the fixed loose portion 59 located on an end opposite to an end on which a fixed arcuate portion 58 is located. In other words, the fixed scroll wrap 52 includes the fixed arcuate portion 58 at its center-side end and the fixed loose portion 59 at its peripheral edge-side end. The fixed loose portion 59 is adjacent to a fixed spiral portion 57.

The movable scroll wrap 62 includes the movable loose portion 69 located on an end opposite to an end on which a movable arcuate portion 68 is located. In other words, the movable scroll wrap 62 includes the movable arcuate portion 68 at its center-side end and the movable loose portion 69 at its peripheral edge-side end. The movable loose portion 69 is adjacent to a movable spiral portion 67.

Each of the fixed loose portion 59 and the movable loose portion 69 extends in a range that is equal to or less than one round of the corresponding scroll wrap. For example, each of the fixed loose portion 59 and the movable loose portion 69 may extend approximately half round of the corresponding scroll wrap. Each of the fixed loose portion 59 and the movable loose portion 69 has a center line or contour that may be formed in an involute curve shape or any curve shape different from the involute curve shape.

Figure 9:
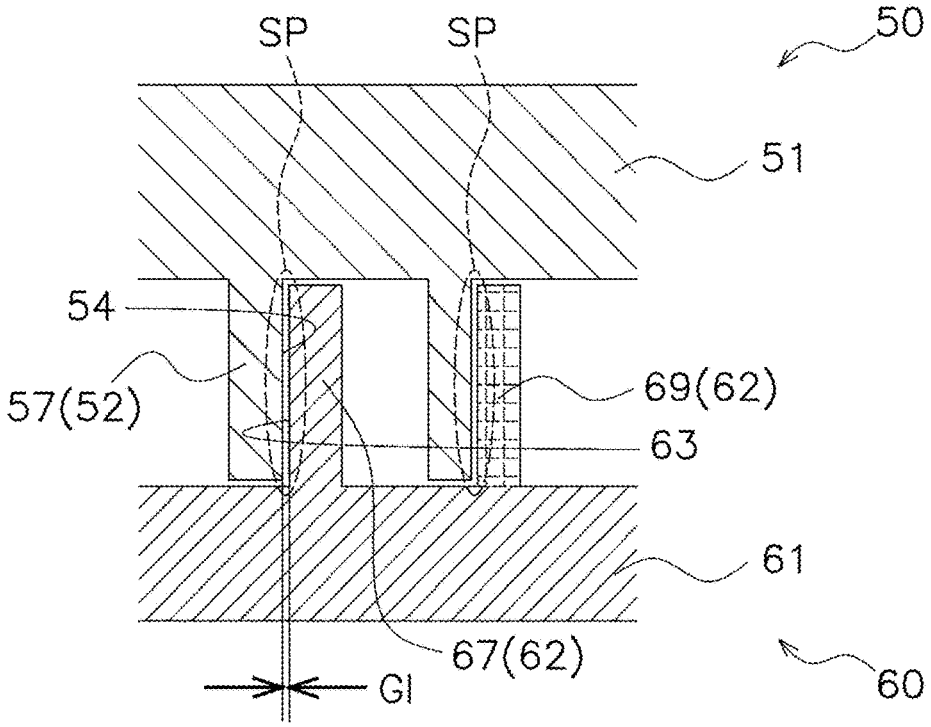
FIG. 9 is a schematic sectional view taken along line IX-IX in FIG. 8.

FIG. 9 illustrates a cross-section of the compression mechanism 40A. As to the fixed scroll wrap 52, FIG. 9 illustrates only the fixed spiral portion 57. As to the movable scroll wrap 62, FIG. 9 illustrates the movable spiral portion 67 and the movable loose portion 69. FIG. 9 illustrates the case in which a movable scroll wrap inner line 63 is the closest to a fixed scroll wrap outer line 54. As in the first embodiment, an interstice between the fixed spiral portion 57 and the movable spiral portion 67 that are in closest proximity to each other is referred to as a spiral portion side surface clearance GI. A larger one of an A chamber side surface clearance and a B chamber side surface clearance is defined as the spiral portion side surface clearance GI. The spiral portion side surface clearance GI illustrated in FIG. 9 is the B chamber side surface clearance.

Figure 10:
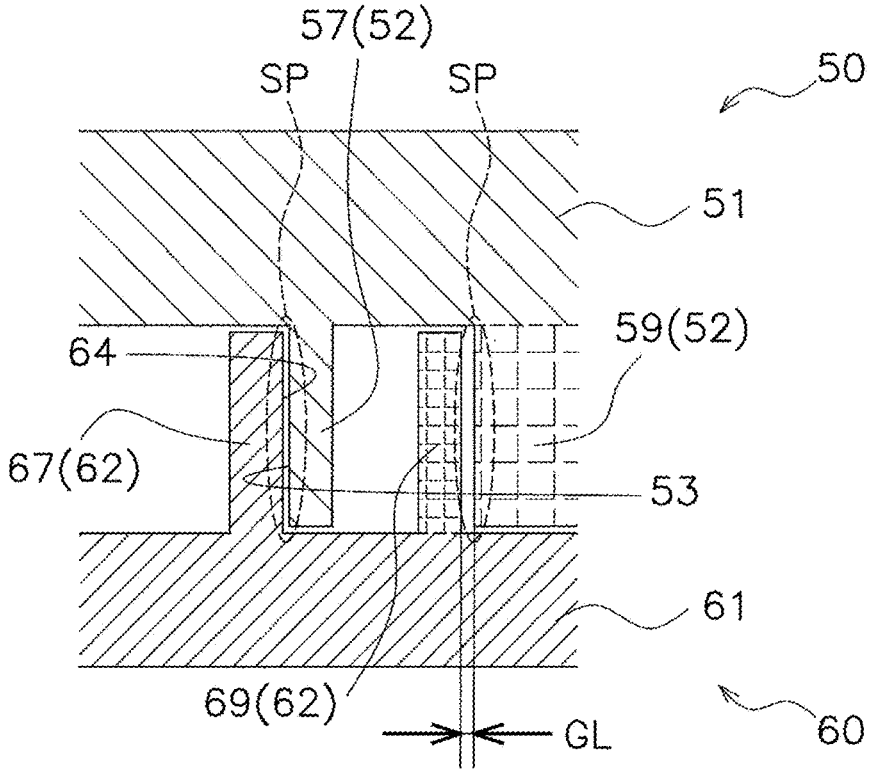
FIG. 10 is a schematic view of movement of a movable scroll 60 illustrated in FIG. 9.

FIG. 10 illustrates the case in which a movable scroll wrap outer line 64 is the closest to a fixed scroll wrap inner line 53. As to the fixed scroll wrap 52, FIG. 10 illustrates the fixed spiral portion 57 and the fixed loose portion 59. A smallest one of an interstice between the movable spiral portion 67 and the fixed loose portion 59, an interstice between the fixed spiral portion 57 and the movable loose portion 69, and an interstice between the fixed loose portion 59 and the movable loose portion 69 is defined as a loose portion side surface clearance GL. The loose portion side surface clearance GL illustrated in FIG. 10 is the interstice between the fixed scroll wrap inner line 53 and the movable scroll wrap outer line 64, that is, the A chamber side surface clearance.

In the scroll compressor 10 according to the second embodiment, the compression mechanism 40A has dimensions set as follows.

The loose portion side surface clearance GL is set to be larger than the spiral portion side surface clearance GI. Specifically, a ratio (GL/GI) of the loose portion side surface clearance GL to the spiral portion side surface clearance GI is equal to or more than 1.2. Furthermore, the ratio (GL/GI) of the loose portion side surface clearance GL to the spiral portion side surface clearance GI may be equal to or less than 10. Preferably, the ratio (GL/GI) is equal to or less than 5.

(2) Feature

The loose portion side surface clearance GL is larger than the spiral portion side surface clearance GI. Accordingly, a pressing force between the scroll wraps is reduced at the fixed loose portion 59 or the movable loose portion 69. This configuration therefore enables improvement in strength of each scroll wrap.

(3) Modifications (3-1) Modification 2A

In the second embodiment, the loose portion side surface clearance GL is defined by a smallest one of the interstice between the movable spiral portion 67 and the fixed loose portion 59, the interstice between the fixed spiral portion 57 and the movable loose portion 69, and the interstice between the fixed loose portion 59 and the movable loose portion 69. Alternatively, the loose portion side surface clearance GL may be defined by a largest one of the three interstices. Still alternatively, the loose portion side surface clearance GL may always be defined by selected one of the three interstices.

This configuration produces an effect of reducing degradation in compression performance even when thermal expansion occurs at a loose portion, and enables a change of limiting conditions concerning design.

(3-2) Modification 2B

In the second embodiment, the fixed scroll wrap 52 includes the fixed loose portion 59, and the movable scroll wrap 62 includes the movable loose portion 69. Alternatively, only one of the fixed loose portion 59 and the movable loose portion 69 may be provided.

(3-3) Others

The modifications of the first embodiment may be applied to the second embodiment.

REFERENCE SIGNS LIST

10: scroll compressor
20: casing
30: motor
40: compression mechanism
50: fixed scroll
51: fixed scroll end plate
52: fixed scroll wrap
53: fixed scroll wrap inner line
54: fixed scroll wrap outer line
57: fixed spiral portion
58: fixed arcuate portion
59: fixed loose portion
60: movable scroll
61: movable scroll end plate
62: movable scroll wrap
63: movable scroll wrap inner line
64: movable scroll wrap outer line
67: movable spiral portion
68: movable arcuate portion
69: movable loose portion
GA: arcuate portion side surface clearance
GI: spiral portion side surface clearance
GL: loose portion side surface clearance

CITATION LIST

Patent Literature

Patent Literature 1: JP 2015-071947 A

The invention claimed is:

1. A scroll compressor comprising:
a fixed scroll including a fixed scroll wrap; and
a movable scroll including a movable scroll wrap,
the fixed scroll wrap including
a fixed spiral portion having a spiral shape, and
a fixed arcuate portion having an arcuate shape, the fixed arcuate portion being smaller in radius of curvature than the fixed spiral portion,
the movable scroll wrap including
a movable spiral portion having a spiral shape, and
a movable arcuate portion having an arcuate shape, the movable arcuate portion being smaller in radius of curvature than the movable spiral portion,
an arcuate portion side surface clearance being
defined by the fixed arcuate portion and one of the movable spiral portion and the movable arcuate portion at where the one of the movable spiral portion and the movable arcuate portion is in a closest proximity to the fixed arcuate portion, or
defined by the movable arcuate portion and one of the fixed spiral portion and the fixed arcuate portion at where the one of the fixed spiral portion and the fixed arcuate portion is in a closest proximity to the movable arcuate portion,
a first spiral portion side surface clearance being defined by the fixed spiral portion and the movable spiral portion at where the fixed spiral portion is in a closest proximity to the movable spiral portion, the first spiral portion side surface clearance being disposed radially outward of the arcuate portion side surface clearance, a second spiral portion side surface clearance being defined by the fixed spiral portion and the movable spiral portion at where the fixed spiral portion is in a closest proximity to the movable spiral portion, the second spiral portion side surface clearance being disposed radially outward of the first spiral portion side surface clearance, the arcuate portion side surface clearance being measured at a tip of one of the fixed arcuate portion and the movable arcuate portion, and the arcuate portion side surface clearance being larger than each of the first and second spiral portion side surface clearances.

2. The scroll compressor according to claim 1, wherein a ratio of the arcuate portion side surface clearance to each of the first and second spiral portion side surface clearances is equal to or more than 1.2.

3. The scroll compressor according to claim 1, wherein at least one of a ratio of a thickness of the fixed arcuate portion to a thickness of the fixed spiral portion and a ratio of a thickness of the movable arcuate portion to a thickness of the movable spiral portion is equal to or more than 1.2.

4. The scroll compressor according to claim 1, wherein each of the first and second spiral portion side surface clearances is a larger one of an A chamber side surface clearance defined by an inner line of the fixed scroll wrap and an outer line of the movable scroll wrap, and a B chamber side surface clearance defined by an outer line of the fixed scroll wrap and an inner line of the movable scroll wrap.

5. The scroll compressor according to claim 1, wherein one of the fixed scroll further includes a fixed loose portion on its end opposite to the fixed arcuate portion, the fixed loose portion being adjacent to the fixed spiral portion, and the movable scroll further includes a movable loose portion on its end opposite to the movable arcuate portion, the movable loose portion being adjacent to the movable spiral portion, a loose portion side surface clearance is defined by the fixed loose portion and one of the movable spiral portion and the movable loose portion, or is defined by the movable loose portion and one of the fixed spiral portion and the fixed loose portion, and the loose portion side surface clearance is larger than each of the first and second spiral portion side surface clearances.

6. The scroll compressor according to claim 1, wherein the scroll compressor is configured to compress a refrigerant higher in discharge temperature than an R410A refrigerant.

* * * * *